United States Patent [19]

Shaver et al.

[11] 4,298,113

[45] Nov. 3, 1981

[54] DRIVE SYSTEM FOR GRINDING MILLS

[75] Inventors: Marvin B. Shaver, Beaconsfield; Robert M. Vadas, Dorval; Norman A. Stock, Lachine, all of Canada

[73] Assignee: Dominion Engineering Works Limited, Lachine, Canada

[21] Appl. No.: 888,017

[22] Filed: Mar. 20, 1978

[30] Foreign Application Priority Data

May 5, 1977 [CA] Canada ..... 277773

[51] Int. Cl.[3] ..... F16D 41/02; F16D 41/28; F16D 43/20

[52] U.S. Cl. ..... 192/0.094; 192/0.034; 192/0.098; 192/12C; 192/58 B; 192/103 F; 192/113 B

[58] Field of Search ..... 192/0.098, 0.034, 0.094, 192/12 C, 56 F, 58 R, 58 B, 103 F, 104 F, 113 B, 0.032, 0.033

[56] References Cited

U.S. PATENT DOCUMENTS

| | | | |
|---|---|---|---|
| 3,369,636 | 2/1968 | Nelson | 192/0.02 |
| 3,561,367 | 2/1971 | Black | 192/56 F |
| 3,563,355 | 2/1971 | Goodson et al. | 192/58 R |
| 3,734,257 | 5/1973 | Eastcott | 192/0.098 X |
| 3,752,284 | 8/1973 | Brittain | 192/103 F |
| 3,757,912 | 9/1973 | Ball, Jr. et al. | 192/0.02 |
| 3,800,930 | 4/1974 | Sommer | 192/103 F X |
| 3,834,502 | 9/1974 | Sommer | 192/103 F X |
| 3,982,615 | 9/1976 | Reed | 192/56 F |

*Primary Examiner*—Allan D. Herrmann
*Attorney, Agent, or Firm*—Raymond A. Eckersley

[57] ABSTRACT

A grinding mill having heavy duty transmission including a hydraulic clutch is provided with an inching capability, a slow running capability, a braking capability and overload prevention, as well as synchronization capability.

6 Claims, 1 Drawing Figure

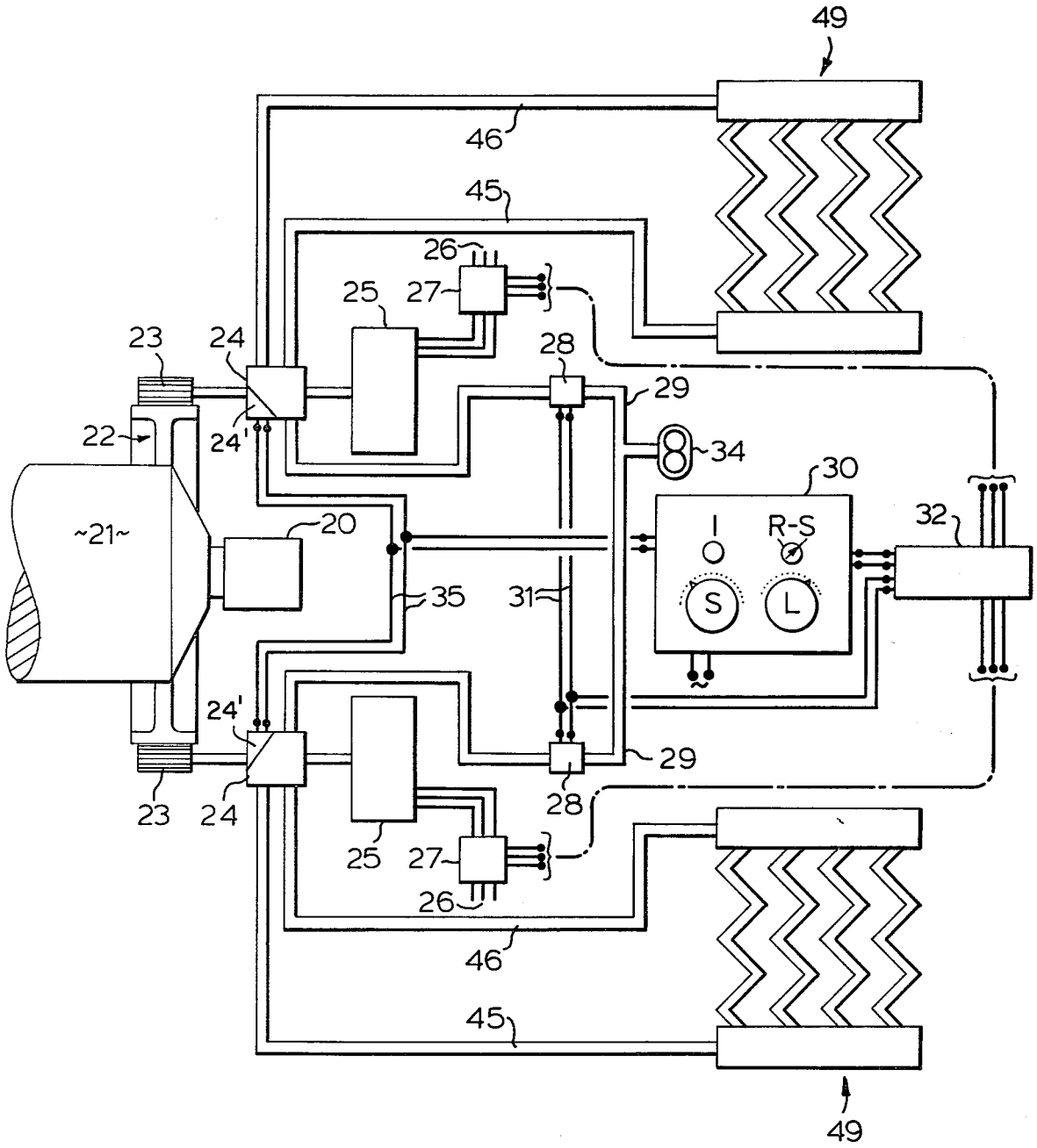
49
46
45
26
27
25
23
24
28
29
22
24'
34
30
~21~
20
R-S
32
35
31
S
L
24'
29
23
24
28
25
27
26
46
45
49

DRIVE SYSTEM FOR GRINDING MILLS

This invention is directed to a power transmission arrangement, and in particular to the provision of a heavy duty drive system incorporating hydraulic clutches.

In the operation of grinding mills such as ball, rod or autogenous mills problems continue to arise with the advent of progressively larger mills, in particular with the provision of efficient and trouble-free drive systems.

The use of twin drive systems incorporating high power synchronous motors of the quadratorque type previously led to the use of air-actuated clutches to permit synchronization of the drive motors, as set forth in U.S. Pat. No. 3,369,636—Nelson, issued Feb. 20, 1968 to the assignee of the present invention.

One of the limitations of this prior arrangement is the matter of clutch overheating, which severely limits the duration and extent of clutch actuation.

In the operation of such mills certain novel phases of activity could be achieved by provision of a greatly enhanced clutching capability over that presently afforded by air clutches. Included in these desired activities is the angular repositioning of the mill drum, by inching, to permit servicing or replacement of the mill liners.

The provision of a hydraulic clutch or clutches of the wet plate type referred to as a wet clutch, having an external coolant circuit or circuit introduce certain unobvious advantages over the previously known use of air clutches. Wet plate clutches, as in normal practice, are controlled by varying the hydraulic pressure applied to the clutch plate servo motor, so as to vary in desired fashion the friction torque transmitted by the plates.

Thus, the wet clutch may be utilized in a distinctly different manner by incorporating in its control program for normal running a closely toleranced overload setting, at which the clutch will slip, to thus limit the gross value of torque which may be transmitted. An alarm or an automatic shut down or automatic mill off-loading arrangement also can be incorporated with this control mode. Thus, once clutch lock-up occurs the torque transmission capability could be increased to a value such as approximately 200% of normal full load torque. This limit of maximum torque load affords protection of the reduction gear or gears against damage due to overload. One previous solution to this problem of over-torquing relied upon shear pins installed in combination with a solid coupling. However, this prior arrangement suffered from the disadvantage that shear pin failure could occur due to fatigue, as distinct from torque overload, without approaching the pre-set value for overload. Thus failure of a shear pin by fatigue, as distinct from torque overload, could cause the expense of a mill shut-down and require the refitting of a new shear pin or pins. This is unduly time consuming and costly, in light of the production loss suffered by mill shut-down.

A further novel function for the system, made possible by the heat dissipation characteristics of the wet clutch, is the provision of an inching drive, wherein the driving motor or motors may be connected in driving relation to the mill through the clutches for a predetermined limited period of time, in order to achieve a limited predetermined degree of mill rotation. The period of clutch activation may thus be selectively varied.

Alternatively, pulsed inching can be achieved by cyclically engaging and disengaging the clutch so as to provide a slow, pulsed forward motion.

This is of particular value in carrying out mill maintenance, such as servicing or changing mill liners, wherein it is sometimes necessary for the maintenance crew to replace liners within the mill while standing upon the charge. The capability of precise inching to a predetermined degree of rotation affords a significant economic advantage in reducing mill down-time.

A further function is the slowing down or locking of the mill drum, using mechanical brake means usually acting on the output side of the clutch, to maintain that portion of the clutch stationary. Controlled energization of the clutches results in release of the brake and drum to the extent desired. This also can significantly speed up the repositioning of the drum during internal maintenance and service work, and enhance safety.

It is further contemplated, that while continuous clutch slip is generally to be avoided on the grounds of obtaining efficient energy utilization, in certain circumstances where the run of mine varies outside generally accepted tolerances so as to adversely affect mill operation, short term corrective action can be taken by permitting a selected degree of clutch slip while maintaining operation of the synchronous motors at normal synchronous speed.

By making provision for clutch cooling to a greater extent than is normally considered necessary, mill rotation at 90% or even 80% of synchronous speed is made possible, wile maintaining synchronous operation of the motor.

The present invention thus provides a drive control arrangement for use with a grinding mill having a drum mounted for rotation on bearing means, a driven gear secured to the drum, at least one pinion supported in driving relation with the driven gear, and electric motor means; comprising wet clutch means interposed in selective connecting relation between the motor means and the pinion, the wet clutch means including an external coolant circuit to dissipate heat generated in the clutch means, and mill control means including pressure responsive means to control the output torque of the clutch means, pressure sensing means for sensing the clutch control pressure, and pressure control means to limit the pressure to a value corresponding to a predetermined value of torque.

The invention further provides inching means to control the actuation of the wet clutch for a controlled period of time, to provide a selectively variable or a predetermined extent of rotation of the drum by the electric motor.

The invention also includes the provision of braking means to immobilize the output half of the clutch, whereby subsequent to actuation of the wet clutch braking torque is applied to the mill drum to bring it to a standstill.

The foregoing provisions of load monitoring, load balancing and load limiting may be effected utilizing a load monitoring arrangement such as a micro-process computer as a controller, which does not form a part of the present invention. The controller can be programmed to provide a controlled rate of mill acceleration, from standstill, by monitoring motor load and modulating the respective clutch load control pressures accordingly, both to control the loading rate and to maintain load balance of the two motors of a twin drive, within predetermined limits.

In accordance with one embodiment of the invention, upon the occurrence of load imbalance between the two motors, beyond a predetermined limit during normal running, the clutches are depressurized to a sufficient extent that continuous slippage occurs, whereat the speed of mill rotation may decrease by a value such as 5% of operating speed. With the mill thus operating at about 95% full speed for instance, one of the clutches is modulated so as to equalize the loading of the motors and an acceleration schedule then initiated to bring the mill back up to full speed. In the case of a mill utilizing a micro-process computer controller, the controller would probably adopt the terminal portion of the normal mill acceleration characteristic or schedule, to regulate the restoration of full speed mill running.

Certain embodiments of the invention are described, reference being made to the accompanying drawing which comprises a schematic arrangement of a portion of a grinding mill incorporating a transmission in accordance with the present invention.

A grinding mill has the drum 21 thereof supported on a pair of end bearings, one bearing 20 being shown. A gear wheel 22 secured in driving relation with the drum 21 is mounted in meshing relation with twin drive pinions 23, each of which is connected by way of a wet clutch 24 with a synchronous electric motor 25.

The motors 25 are energized by electrical supply circuits 26 and control switches 27.

Admission of clutch load control fluid directly to the clutches 24 by way of supply pipes 29 connected with supply pump 34 is controlled through pressure varying control valves 28. The individual values of control pressure admitted by the valves. The valves 28 are modulated electrically through a multi-function controller 30, by electrical connections 31 providing pressure control and pressure feed-back interconnections with a micro processor 32 forming a part of controller 30. A fluid pressure control L, which is indicated as being a manually settable pressure responsive control means provides a base input to the processor 32 and determines as a function of clutch actuation pressure the desired normal operating torque transmitted by the clutches, being tied to the operation of the other functions of the controller 30. Alternatively or additionally, a limiting value for operating torque as a function of clutch pressure is programmed in the micro-processor 32 acting as a pressure sensing means of the controller 30.

Each clutch 24 is provided on the clutch output side with a brke 24', (not shown), having a pull-off control connected by electrical connections 35 with the start-run control R-S of controller 30. The start-run control R-S is a manually operable control having a "start" position S and a "run" position R, illustrated as being in the "start" position.

Each wet clutch 24 is provided with coolant connections 45, 46, connected to a cooler 49, to permit dissipation of heat generated in the wet clutches during operation in a slipping mode.

The controller 30 is illustrated as having (a) an inching facility with a selector 'S' permitting the selection of a predetermined extent of drum rotation; (b) an inching start button 'I'; (c) a start-to-run button "R-S". Actuation of the clutch releases the brake.

Upon selection of a value of inching rotation by adjustment of the selector 'S', and with activation of inching switch 'I' the mill will be driven to the predetermined position by the appropriate energizatin of the clutches 24 for the preselected time.

Alternatively, using an "aborted start" manually controlled technique, by initiating and then terminating a startup, an inching impulse of desired duration may be obtained.

During the operation of the mill, when the clutches are selectively and progressively deactivated the loaded mill decelerates rapidly until it comes to a halt, held against the load by a slight torque through the clutches. Upon further deactivation of the clutches the mill slowly runs back, under the load. When the load is at bottom centre, total deactivation of the clutches will then apply the clutch brakes, to hold the mill at a standstill. Stopping the mill in this controlled fashion can save time during stops. In the case of an unloaded mill, which tends to free wheel more readily, the braking capacity of the clutch brakes can be made sufficient to significantly reduce mill roll-down time, by acting as a retarder, as well as a holding brake.

The start-to-run control R-S connects the micro processor 32 with the pressure control 28, so that the starting schedule can limit the clutch actuation pressure in a desired range, to transmit start-up torque which may have instantaneous values less than or significantly exceeding normal running torque.

The use of clutches can obviate the need for shear pins or othe like safety devices by the monitoring to close limits of the working torque during normal running. Twin mill drives using quadratorque motors can particularly benefit in this respect as it is the possibility of the motors being out of phase which introduces the greatest risk of the occurrence of destructive overload. In systems even using standard synchronous motors the motor torque produced under electrical fault conditions can be sufficiently high that use of the present invention is beneficial with regard to limiting the maximum torque.

In general, the limiting torque value selected for the clutches is a function of the equivalent failure torque of the weakest portion of the drive train. As an example in the case where the gear teeth are selected as being the weakest link, a value of limiting torque of approximately 2.5 of full load torque might be appropriate.

It will be appreciated that other functioning modes of the present arrangement using the inching or the deceleration capability of the clutches can apply also to installations having a single drive motor.

In operation, by monitoring the electrical consumption of each of the motors 25 the state of balance between the loads carried by the motors can be determined. When a predetermined value of load out-of-balance occurs the method adopted for rebalancing the motor loads involves the steps of: reducing energization of the hydraulic clutches 24 to a sufficient extent that mill speed drops to about 95% of synchronous speed. This assures a condition of dynamic friction in the clutches, to avoid the uncertainties which would otherwise exist if a smaller value of slip was elected, wherein a non-sliding friction coefficient might apply part of the time. The loading of one clutch may then be varied in relation to the other clutch until the motor loads are balanced within the desired tolerance, at which time an acceleration schedule is adopted and the mill brought up to operating speed by modulating clutch control pressure in accordance with a desired acceleration schedule. In the case of the illustrated embodiment incorporating the micro processor 32, the reacceleration schedule from 95% full speed up to running speed would usually comprise that portion of the normal acceleration schedule covering this speed range.

In referring to different types of clutches the terminology wet clutch and dry clutch refer respectively to clutches wherein the plates are liquid lubricated or dry, respectively. Of these types of clutches, some employ hyraulic controls, some employ pneumatic controls, or combinations of both.

In general it is contemplated that the precision of operation proposed in the present disclosure will more readily be achieved using hydraulic controls.

In the operation of the mill, in addition to utilizing the clutch brake or brakes for purposes of slowing or positioning the mill; when the mill has been brought to a standstill, controlled and limited energization of the clutch or clutches while the clutch brake is still fully engaged can usefully bring the electric drive motors to a halt. During such operation, the excess energy is dissipated through the clutch cooling system, care being taken that the clutch braking torque does not exceed the load holding capability of the clutch brake. Such operation facilitates servicing of the drive motors simultaneously with servicing of the mill per se.

What I claim as new and desire to secure by Letters Patent of the United States is:

1. A drive control arrangement, for use with a grinding mill having a drum mounted for rotation on bearing means, a driven gear secured to the drum, twin pinions supported in driving relation with the driven gear, each having an electric motor in driving relation therewith wet clutch means interposed in selective connecting relation between at least one of the said pinions and the related said motor and being generally operative in non-slipping relation therebetween, said wet clutch means including an external coolant circuit to dissipate heat generated in the clutch means, and control means operable to control and selectively interrupt said non-slipping relation including pressure responsive means to control the output torque of the clutch means, pressure sensing means for sensing said clutch control pressure, and pressure control means to limit said pressure to a value corresponding to a predetermined value of torque.

2. The drive arrangement as claimed in claim 1 including braking means to provide selective immobilization of the output side of said clutch means, whereby during rotation of said mill, upon selective immobilization of said clutch output side by de-activation of said clutch means, the consequent energization of said braking means to a desired torque value serves to brake said mill drum to a standstill at a controlled rate of energy dissipation.

3. The drive arrangement as claimed in claim 1 in combination with said mill, said control means including inching means to apply a predetermined value of pressure for a predetermined time to said clutch means to provide a predetermined extent of rotation of said drum by said electric motor.

4. The combination as claimed in claim 3, said pinions each driven by a respective said electric motor, each having a said wet clutch, said pressure control means limiting running operation of said clutch means by limiting said control pressure to a predetermined function of normal operating pressure to prevent the transmission of torque forces destructive to said driven gear and said pinions.

5. The drive arrangement as claimed in claim 4 said torque control means including programmed means containing a programed mill acceleration schedule to control said clutch control pressure within predetermined limits, for a selected schedule, and control circuit means connecting said control means to said clutches in modulating relation therewith to actuate the clutches at predetermined rates whereby the mill is accelerated in accordance with the schedule.

6. The drive arrangement as claimed in claim 5, said programmed means including motor load monitoring means, load comparater means, and output means in modulating control relation with said clutch torque control means.

* * * * *